US006501932B2

(12) United States Patent
Obu et al.

(10) Patent No.: US 6,501,932 B2
(45) Date of Patent: Dec. 31, 2002

(54) IMAGE FORMING APPARATUS USING A DEVELOPING LIQUID, DEVELOPING DEVICE THEREFOR AND PROGRAM RECORDING MEDIUM

(75) Inventors: Makoto Obu, Yokohama (JP); Noriyasu Takeuchi, Kawasaki (JP); Tsutomu Sasaki, Yokohama (JP); Mie Yoshino, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/078,351

(22) Filed: Feb. 21, 2002

(65) Prior Publication Data

US 2002/0076240 A1 Jun. 20, 2002

Related U.S. Application Data

(63) Continuation of application No. 09/556,526, filed on Apr. 21, 2000.

(30) Foreign Application Priority Data

Apr. 23, 1999 (JP) ..... 11-116153
Oct. 25, 1999 (JP) ..... 11-302060
Mar. 3, 2000 (JP) ..... 2000-058765

(51) Int. Cl.[7] ..... G03G 15/10
(52) U.S. Cl. ..... 399/237; 399/249
(58) Field of Search ..... 399/237, 239, 399/249

(56) References Cited

U.S. PATENT DOCUMENTS 3,667,428 A * 6/1972 Smith ..... 399/239
4,024,838 A * 5/1977 Horie ..... 399/239
4,264,191 A * 4/1981 Gerbasi et al. ..... 399/239
4,640,605 A * 2/1987 Ariyama et al. ..... 399/249 X
4,720,731 A * 1/1988 Suzuki et al. ..... 399/239
4,800,839 A * 1/1989 Ariyama et al. ..... 399/57
4,801,965 A * 1/1989 Mochizuki et al. ..... 399/29
4,833,500 A * 5/1989 Mochizuki et al. ..... 399/240 X
5,021,834 A * 6/1991 Tsuruoka et al. ..... 399/249
5,155,534 A * 10/1992 Kurotori et al. ..... 399/237
RE34,437 E * 11/1993 Ariyama et al. ..... 399/225
5,539,503 A * 7/1996 Johnson ..... 399/237
5,642,188 A * 6/1997 Mochizuki et al. ..... 399/237
5,652,080 A * 7/1997 Yoshino et al. ..... 430/119
5,666,615 A * 9/1997 Nguyen ..... 399/249 X
5,666,616 A * 9/1997 Yoshino et al. ..... 399/240
5,708,938 A * 1/1998 Takeuchi et al. ..... 399/250
5,923,930 A * 7/1999 Tsukamoto et al. ..... 399/237
5,937,247 A * 8/1999 Takeuchi et al. ..... 399/237

(List continued on next page.)

FOREIGN PATENT DOCUMENTS

JP 7-334004 * 12/1995
JP 11-223997 * 8/1999

*Primary Examiner*—Fred L Braun
(74) *Attorney, Agent, or Firm*—Oblon, Spivak, McClelland, Maier & Neustadt, P.C.

(57) ABSTRACT

An image forming apparatus and a developing device that can deposit a developing liquid on a liquid carrier in a form of a thin layer, causing the thin layer to contact an image carrier of the image forming apparatus. A liquid carrier is in contact with the image carrier to carry the thin layer of the developing liquid to the image carrier. A thin layer contact member contacts the thin layer formed on the liquid carrier at a position upstream of where the liquid carrier and the image carrier contact each other in a direction in which the liquid carrier is movable, to apply a shearing force to the thin layer. Further, the thin layer contact member includes a rotary member with a movable surface that rotates, at a position where the rotary member faces the liquid carrier, in a rotating direction opposite to the rotation direction in which the liquid carrier is movable.

4 Claims, 9 Drawing Sheets

U.S. PATENT DOCUMENTS 5,953,559 A * 9/1999 Obu ..... 399/110
5,987,281 A * 11/1999 Kurotori et al. ..... 399/237
5,987,282 A * 11/1999 Tsukomoto et al. ..... 399/237
5,999,779 A * 12/1999 Takeuchi ..... 399/239
6,038,421 A * 3/2000 Yoshino et al. ..... 399/239
6,072,972 A * 6/2000 Obu et al. ..... 399/237
6,101,355 A * 8/2000 Matsumoto et al. ..... 399/239
6,108,508 A * 8/2000 Takeuchi et al. ..... 399/239 X
6,167,225 A * 12/2000 Sasaki et al. ..... 399/239 X

* cited by examiner

IMAGE FORMING APPARATUS USING A DEVELOPING LIQUID, DEVELOPING DEVICE THEREFOR AND PROGRAM RECORDING MEDIUM

BACKGROUND OF THE INVENTION

The present invention relates to a copier, facsimile apparatus, printer or similar image forming apparatus using a developing liquid, a developing device therefor, and a program recording medium. More particularly, the present invention relates to an image forming apparatus of the type developing a latent image formed on an image carrier with a developing liquid or an image forming substance contained therein, a developing device therefor, and a program recording medium.

It is a common practice with an image forming apparatus of the type described to electrophotographically form an image by the following procedure. A data writing unit writes image data on the surface of an image carrier uniformly charged by charging means. As a result, a latent image corresponding to the image data is electrostatically formed on the image carrier. An image forming substance contained in a developing liquid fed from a developing device develops the latent image to thereby produce a corresponding visible image. The visible image is transferred from the image carrier to a paper or similar recording medium fed from, e.g., a cassette. After a fixing unit has fixed the image on the paper, the paper is driven out of the apparatus to a tray. After the image transfer, cleaning means removes the developing liquid and image forming substance left on the image carrier. Subsequently. discharging means discharges the image carrier to thereby prepare it for the next image forming cycle.

The above image forming apparatus is operable with a developing liquid consisting of a carrier liquid and toner, i.e. , an image forming substance. Japanese Patent Laid-Open Publication No. 7-209922, for example, discloses an image forming apparatus using a developing liquid having viscosity of 100 mPa·S to 10,000 mPa·s for developing a latent image formed on a photoconductive element or image carrier. Specifically, a developing device included in the apparatus includes a developer carrier implemented as a developing roller or a developing belt. While the developing liquid is deposited on the above roller or belt in a thin layer, a prewetting liquid is applied to a latent image on the photoconductive element. Toner contained in the thin layer is caused to electrostatically migrate toward the latent image in the carrier liquid and presetting liquid (electrophoresis), thereby forming a toner image. As a result, a sharp image is transferred from the photoconductive element to a paper or similar recording medium with high quality. The above document teaches that the presetting liquid applied to the photoconductive element prevents the toner from depositing on the non-image area of the element and disturbing the image.

The developing liquid may be implemented as liquid ink containing dyestuffs or similar image forming substance, as taught in, e.g., Japanese Patent Laid-Open Publication No. 48-16644. Japanese Patent Laid-Open Publication No. 50-99157, for example, proposes an image forming apparatus capable of forming an image with silicone oil or similar dielectric open fluid and liquid ink having a greater adhering force than the dielectric open fluid. The dielectric open fluid is applied to a charge holding surface, or image carrier, forming an open layer. At the same time, the dielectric open fluid is applied to the surface of an ink applying member or liquid carrier in order to form an open layer, and then the liquid ink is applied thereto. During development, the charge holding surface and ink applying member are caused to face each other while sandwiching the open layer, liquid ink, and open layer. Subsequently, the charge holding surface and ink applying member are moved away from each other, causing the intermediate liquid ink to electrostatically adhere to the open layer of the charge holding surface. The ink deposited on the open layer develops the latent image. Because the open layer of the ink applying member has a smaller adhering force than the ink, the ink does not remain on the ink applying member; rather, the open layer migrates toward the charge holding surface together with the liquid ink over at least part of its thickness.

Some liquids have a viscosity characteristic dependent on a shearing force, as well known in the art. This kind of liquid sequentially reduces its viscosity up to a saturation level when subjected to a shearing force derived from, e.g., agitation. When the liquid is left without any shearing force acting thereon, the viscosity sequentially increases toward a saturation level. Many of viscous developing liquids containing dense toner in a carrier liquid have this kind of characteristic.

The inventors found by researches and experiments that various problems arose when a developing liquid of the type described was applied to any one of the conventional image forming apparatuses. For example, when liquid ink whose viscosity is dependent on a shearing force is applied to the apparatus taught in the above Laid-Open Publication No. 48-16644, a ripple having a sufficient amplitude cannot occur in the ink having been left unused and therefore having increased viscosity. It is therefore likely that the ink and photoconductive element cannot sufficiently contact each other. It follows that image density is apt to be short before the ink left unused over a long period of time has its viscosity sufficiently lowered by, e.g., agitation.

Assume that the developing liquid of the kind described is applied to the apparatus disclosed in Laid-Open Publication No. 7-209922. Then, toner contained in the liquid left unused and increased in viscosity migrates at a lower speed based on electrophoresis than toner contained in the liquid lowered in viscosity by a shearing force. The resulting short deposition of the toner makes image density short. Moreover, the toner failed to migrate remains on the non-image area of the photoconductive element, contaminating the background of an image. In addition, it is difficult to separate the portions of the above liquid corresponding to the image area and non-image area, respectively, from each other due to tacking, causing the edges of an image to appear blurred and thereby degrading the sharpness of the image. Sharpness is also degraded when a developing liquid whose viscosity characteristic is dependent on a shearing force is applied to the above apparatus.

Technologies relating to the present invention are also disclosed, in, e.g., Japanese Patent Laid-Open Publication Nos. 7-334004 and 11-223997.

SUMMARY OF THE INVENTION

It is therefore an object of the present invention to provide an image forming apparatus al lowing a minimum of short image density, background contamination and short image sharpness to occur despite the use of a developing liquid whose viscosity characteristic is dependent on a shearing force, a developing device therefor, and a program recording medium.

In accordance with the present invention, an image forming apparatus for depositing a thin layer of a developing liquid or an image forming substance contained therein on a latent image formed on an image carrier to thereby develop the latent image includes a liquid storing portion for storing the liquid, a liquid carrier movable while conveying the liquid deposited thereon, and a first agitating member for agitating the liquid stored in the liquid storing portion. Before the liquid carrier starts being driven for developing the latent image, the agitating member is caused to start agitating the developing liquid.

Also, in accordance with the present invention, in a developing device for depositing a developing liquid on a liquid carrier in the form of a thin layer, causing the thin layer to contact an image carrier included in an image forming apparatus, and depositing the thin layer or an image forming substance contained therein on a latent image formed on the image carrier to thereby develop the latent image, a thin layer contact member contacts the thin layer formed on the liquid carrier at a position upstream of a position where the liquid carrier and image carrier contact each other in a direction in which the liquid carrier is movable.

Further, in accordance with the present invention, in a program recording medium for mechanically recording a control program applicable to a control unit included in an image forming apparatus including a liquid storing portion for storing a developing liquid, a liquid carrier movable while conveying the liquid deposited thereon, an agitating member for agitating the liquid in the liquid storing portion, an image carrier for forming a latent image thereon, and the control unit for controllably driving the liquid carrier and agitating member on the basis of the control program, the developing liquid deposited on the liquid carrier in a thin layer or an image forming substance contained therein depositing on the latent image to thereby develop the latent image, the control unit stores the control program for starting driving the agitating member before starting driving the liquid carrier for developing the latent image.

BRIEF DESCRIPTION OF THE DRAWINGS

The above and other objects, features and advantages of the present invention will become more apparent from the following detailed description taken with the accompanying drawings in which:

FIG. 10, [II], is a graph showing a relation between the shear stress of a developing liquid and the rotation speed of an applicator roller;

FIG. 10, [III], is a graph showing a relation between the viscosity of a developing 1 quid and the ratio of toner migration and a relation between the image density and the above ratio;

DESCRIPTION OF THE PREFERRED EMBODIMENTS

Figure 1A:
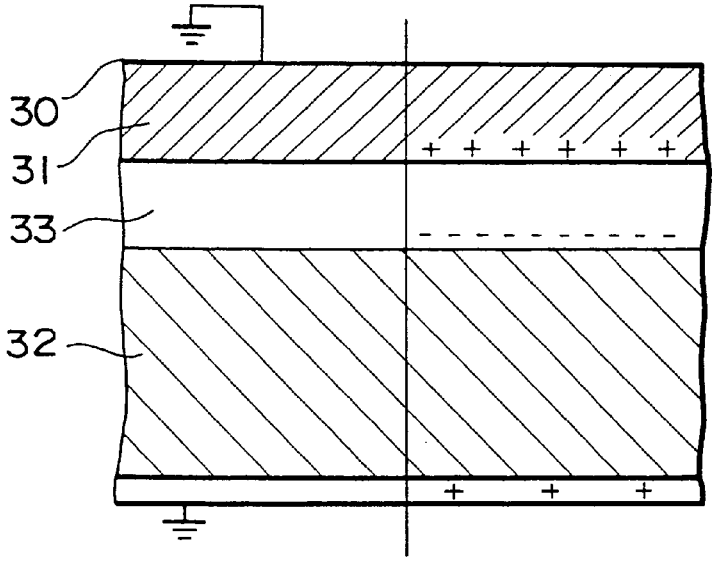
FIG. 1A PRIOR ART
FIGS. 1A and 1B are views showing essential part of a conventional image forming apparatus.
Figure 1B:
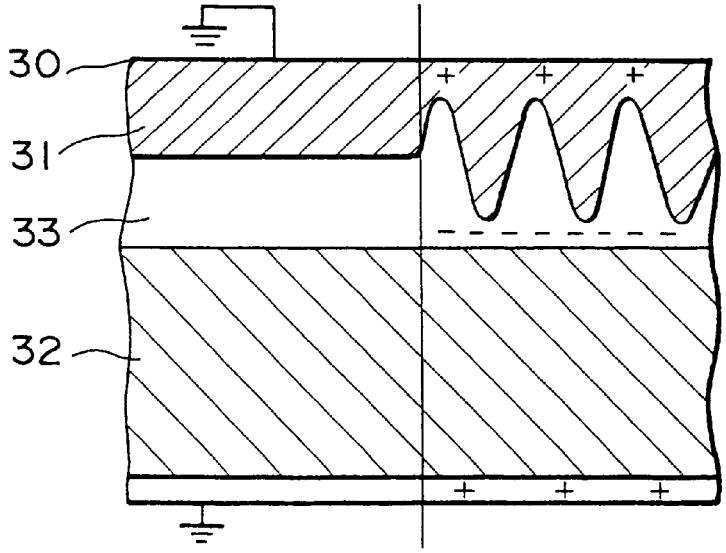
FIG. 1B PRIOR ART

To better understand the present invention, brief reference will be made to an image forming apparatus taught in Japanese Patent Laid-Open Publication No. 48-16644 mentioned earlier, shown in FIGS. 1A and 1B. As shown in FIG. 1A, a latent image is electrostatically formed on a photoconductor 30 in the form of a non-exposed area of negative potential. A dielectric liquid film 31 is formed on the surface of the photoconductor 30 by wetting using silicone oil or similar dielectric liquid. A dielectric ink film 33 is formed on the surface of a developing electrode or liquid carrier 32. As shown in FIG. 1B, when the dielectric film 31 and dielectric ink film 33 are brought into contact with each other during development, a ripple occurs at the interface between them due to charge induction. When the amplitude of the ripple exceeds the total thickness of the films 31 and 33, ink deposits on the latent image formed on the photoconductor 30. This kind of scheme, however, brings about the previously stated problem when use is made of ink whose viscosity characteristic is dependent on a shearing force.

Preferred embodiments of the present invention will be described hereinafter which are applied to an electrophotographic printer using a developing liquid by way of example.

First Embodiment

First, the general construction of the printer to which the illustrative embodiment is applied will be described with reference to FIG. 2. As shown, the printer includes a photoconductive drum or image carrier 1 rotatable counterclockwise, as viewed in FIG. 2, by being driven by drive means (not shown). A charge roller or charging means 2 uniformly charges the surface of the drum 1 in rotation. An optical writing unit or exposing means 3 scans the charged surface of the drum 1 with a laser beam in accordance with image data, thereby electrostatically forming a latent image on the drum 1. When the latent image is conveyed by the drum 1 to a nip between the drum 1 and a developing roller 101 included in developing device 100, the developing roller 101 deposits charged toner on the latent image due to electrophoresis. As a result, the latent image is developed to become a toner image.

A paper cassette 5 is loaded with a stack of papers 6. A pickup roller 19 and a separator roller pair 20 cooperate to pay out the papers 6 from the paper cassette 5 toward a nip between a transfer roller 7 and the drum 1 one by one. A bias power source, not shown, applies a bias for image transfer to the transfer roller 7, forming an electric field at the nip between the transfer roller 7 and the drum 1. When the paper 6 paid out from the paper cassette 5 is brought to the above nip and superposed on the toner image, the toner image is transferred from the drum 1 to the paper 6 by the pressure of the drum 1 and transfer roller 7 and the electric field. The paper 6 with the toner image is conveyed toward a fixing unit 8 including a heat roller 8*a* and a press roller 8*b* contacting each other. The heat roller 8*a* and press roller 8*b* fix the toner image on the paper 6 with heat and pressure. The paper 6 with the fixed image is driven out of the printer.

After the image transfer, a cleaning unit 9 removes the toner left on the surface of the drum 1 with a cleaning blade 9*a*. A discharger, not shown, discharges the surface of the drum 1 so as to prepare it for the next image forming cycle.

The developing device 100 includes a liquid storing portion 104 storing a developing liquid 10 consisting of a carrier liquid and toner or image forming substance. The liquid storing portion 104 will be described specifically later. The developing liquid 10 has a viscosity characteristic dependent on a shearing force and has a raised saturation viscosity of 100 mPa·s to 1,000 mPa·s. The lowered saturation viscosity of the liquid 10 is less than about one half of the raised saturation viscosity. For example, when the raised saturation viscosity is 300 mPa S, the lowered saturation viscosity is about 100 mPa·s; when the former is about 1,000 mPa·s, the latter is 300 mPa·s to 500 mPa·s. This kind of fluid is sometimes referred to as a non-Newtonian fluid.

Figure 3:
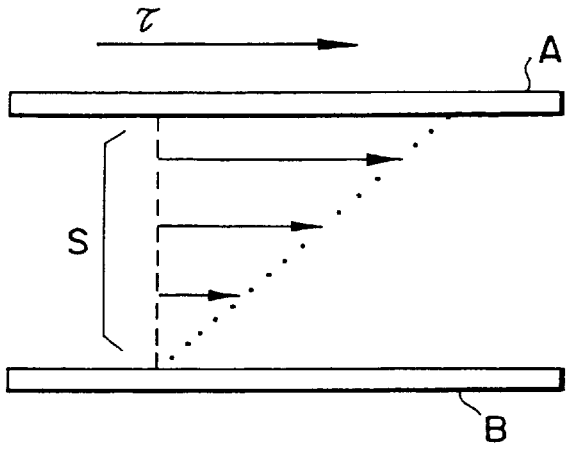
FIG. 3 is a view for describing how the viscosity characteristic of a developing liquid is dependent on a shearing force.

Reference will be made to FIG. 3 for describing the above viscosity characteristic of the developing liquid 10 more specifically. As shown, a gap between an upper plate A and a lower plate B substantially parallel to each other is filled with the liquid 10. When the upper plate A is moved relative to the lower plate B with a shear stress $\tau$ in a direction indicated by an arrow, the liquid 10 is moved in the same direction as the upper plate A. As a result, a velocity slope S occurs in the layer of the liquid 10 and generates the shear stress $\tau$ in the layer. The shear stress $\tau$ and velocity slope S have a relation of $\tau=\eta S$ where $\eta$ denotes a viscosity or viscosity coefficient. The viscosity 72 sequentially decreases with an increase in shear stress, as well known in the art.

Referring again to FIG. 2, a reservoir or tank 11 is located at one side of the developing device 100 and stores a developing liquid 12 to be replenished to the liquid storing portion 104. A pipe 13 provides fluid communication between the reservoir 11 and the liquid storing portion 104. A pump 14 is disposed in the pipe 13 for delivering the developing liquid 12 from the reservoir 11 to the storing portion 104. The pump 14 is implemented by a gear pump or a tube pump by way of example. Specifically, when the liquid level in the storing portion 104 is lowered due to repeated development, the pump 14 is driven to replenish the liquid 12 into the storing portion 104. A screw or agitating means 15 is disposed in the reservoir 11 and driven clockwise, as viewed in FIG. 2, by drive means (not shown) so as to agitate the liquid 12.

Figure 4:
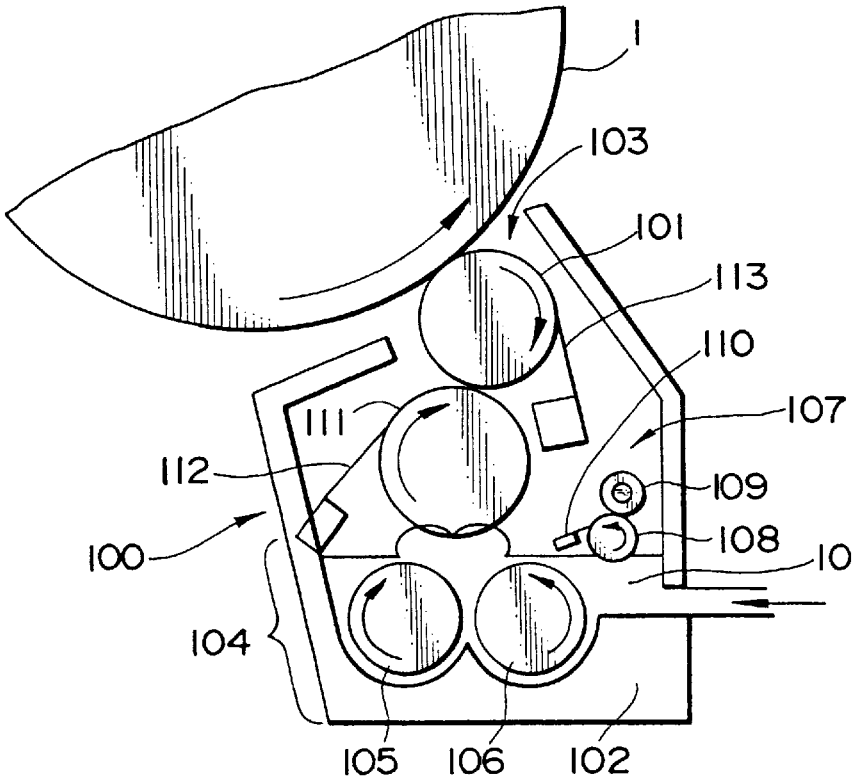
FIG. 4 is a view showing a developing device included in the above printer in detail.

FIG. 4 shows the configuration of the developing device 100 in detail. As shown, the developing device 100 includes a casing 102 having an opening 103 at its top. The developing roller or liquid carrier 101 is positioned in the casing 102 and partly exposed to the outside via the opening 103. The part of the developing roller 101 exposed to the outside is held in contact with the drum 1, forming the nip for development. Two screws or agitating members 105 and 106 are arranged in the liquid storing portion 104. The screws 105 and 106 are respectively rotated clockwise and counterclockwise by drive means, not shown, agitating the developing liquid 10.

A liquid level sensing device 107 adjoins the surface of the developing liquid 10 existing in the liquid storing portion 104 so as to sense the liquid level. The device 107 is made up of a roller 108 rotated counterclockwise, as viewed in FIG. 4, by drive means, not shown, and a sensor 109. So long as the surface of the liquid 10 contacts the roller 108 in rotation, the liquid 10 is deposited on the roller 108 and sensed by the sensor 109. When the surface of the liquid 10 does not contact the roller 108, the liquid 10 is not deposited on the roller 108 or sensed by the sensor 109. In this manner, the device 107 determines whether or not the liquid level is higher than the roller 108 or lower than the same on the basis of the deposition of the liquid 10 on the roller 108. If the liquid level is lower than the roller 108, as determined by the device 107, the pump 14 is driven for a preselected period of time to replenish the developing liquid 104 into the storing portion 104. A cleaning blade 110 cleans the surface of the roller 108, i.e., scrapes off the liquid 10 deposited on the roller 108 after the liquid 10 has moved away from the sensor 109. This is successful to obviate the erroneous sensing of the sensor 109.

An applicator roller or feeding device 111 is located to face the screws 105 and 106 at a position slightly above the liquid level in the liquid storing portion 104. The applicator roller 111 is rotated, counterclockwise, as viewed in FIG. 4, by drive means, not shown. The applicator roller 111 has its surface carved to have fine undulation, so that the developing liquid 10 can easily deposit on the roller surface.

While the applicator roller 111 is positioned above the liquid level in the liquid storing portion 104, the developing liquid 10 can deposit on the surface of the roller 111, as follows. When the screw 105 is rotated counterclockwise, the screw 105 conveys the liquid 10 around it in the counterclockwise direction. On the other hand, when the screw 106 is rotated clockwise, the screw 106 conveys the liquid 10 around it in the clockwise direction. Such two parts of the liquid 10 run against each other between the screws 105 and 106. Consequently, the surface of the liquid 10 partly rises between the screws 105 and 106 and contacts the applicator roller 111, as illustrated.

A metering blade 112 is held in contact with the applicator roller 111, defining a regulating position. While the applicator roller 111 is in rotation, the metering blade 112 regulates the thickness of the liquid layer being conveyed by the applicator roller 111 via the regulation position. The developing roller 101 is positioned above and in contact with the applicator roller 111 and driven clockwise by drive means (not shown). The developing roller 101 and applicator roller 111 contacting each other define an applying position. When the liquid 10 moved away from the regulating position is brought to the applying position, it is partly transferred to the developing roller 101 in a thin layer. The developing roller 101 conveys the thin liquid layer to the nip between the roller 101 and the drum 1, i.e., the nip for development.

A bias power source for development, not shown, applies a bias to the developing roller 101. The bias forms an electric field for development between the latent image formed on the drum 1 and the developing roller 101. The electric field exerts an electrostatic force on the charged toner of the developing liquid 10 existing at the nip for development, causing the toner to move from the developing roller 101 toward the latent image due to electrophoresis. On the other hand, a non-development electric field is formed between the non-image area of the drum 1 and the developing roller 101. This electric field exerts an electrostatic force on the toner of the liquid existing at the nip such that the toner migrates from the latent image toward the developing roller 101 due to electrophoresis.

A flexible cleaning blade 113 is held in contact with the developing roller 101 for scraping off the part of the developing liquid 10 moved away from the above nip and left on the developing roller 101. The liquid 10 collected by the blade 113 is returned to the liquid storing portion 104. At this instant, the toner content of the liquid 10 left on the developing roller 101 after development is different from the toner content before development. If such a liquid left on the developing roller 101 is likely to effect the toner content of the liquid 10 existing in the storing portion 104, it may be returned to the storing portion 104 or the reservoir 11 by way of, e.g., a toner content adjusting device (not shown).

When the above printer is held in a stand-by state over a long period of time without any printing operation, the toner distribution, i.e., toner content of the developing liquid 10, becomes irregular due to, e.g., the precipitation of the toner. Also, the viscosity of the liquid 10 increases to the raised saturation level, e.g., 1,000 mPa·s.

A certain period of time is necessary for the screws 105 and 106 to agitate the above developing liquid 10 until the toner content becomes stable or until the viscosity decreases to the lowered saturation level, e.g., 100 mPa·s. Assume that the screws 105 and 106, applicator roller 111 and developing roller 101 are caused to start rotating at the same time at the beginning of a printing operation. Then, the liquid 10 left with increased viscosity and unstable toner content for a certain period of time is transferred from the applicator roller 111 to the developing roller 101. As a result, the thin layer of the liquid 10 whose toner content is unstable is deposited on the developing roller 101 to a thickness greater than a target thickness, rendering image density unstable or smearing the background of an image. Further, the drive means for driving the above rotary members are required to output high torque, increasing the cost and weight of the printer. At the same time, drive transmitting members associated with the rotary members, the metering blade 112 and cleaning blades 113 and 110 must be rigid enough to withstand heavy loads, further increasing the cost and weight of the printer. Moreover, the metering blade 112 and cleaning blades 13 and 110 formed of rigid materials are apt to fail to closely contact the associated rotary members, making the regulation of the liquid thickness and cleaning defective.

In light of the above, the illustrative embodiment includes the following unique arrangements. When the printer held in a stand-by state starts a printing operation, the screw members 105 and 106 in the liquid storing portion 104 and the screw 15 in the reservoir It are caused to start rotating first. Subsequently, the rotary members including the drum 1, developing roller 101, applicator 6 roller and transfer roller 7 are caused to rotate. The screws 105 and 106 and the screw 15 may start rotating at the same time, or either one of them may start rotating later than the other. The crux is that the screws 105, 106 and 15 start rotating earlier than the applicator roller 111. This allows the developing liquid 10 to deposit on the developing roller 1 after the developing liquids 10 and 12 have been reduced in viscosity and uniformed in toner content. The toner can therefore selectively migrate toward the drum 1 or toward the developing roller 101 at the nip for development due to electrophoresis. In addition, the drive transmitting members, metering blade 112 and blades 113 and 110 do not have to be formed of rigid materials.

The screw 15 in the reservoir 1t is caused to start rotating at the same time as the screws 105 and 106 in the liquid storing portion 104 before the applicator roller 111, as stated above. This is successful to prevent the developing liquid 12 with unstable toner content or high viscosity from being fed to the developing roller 101. However, if an arrangement is made such that the pump 14 is not operated during the interval between the start of rotation of the screw 15 and the decrease in the viscosity of the liquid 12, the applicator roller 111 may start rotating before the screw 15. If the reservoir 11 is absent, i.e., if the liquid 10 in the liquid storing portion 104 is directly fed to the developing roller 101, the screws 105 and 106 may start rotating before the developing roller 101.

Figure 2:
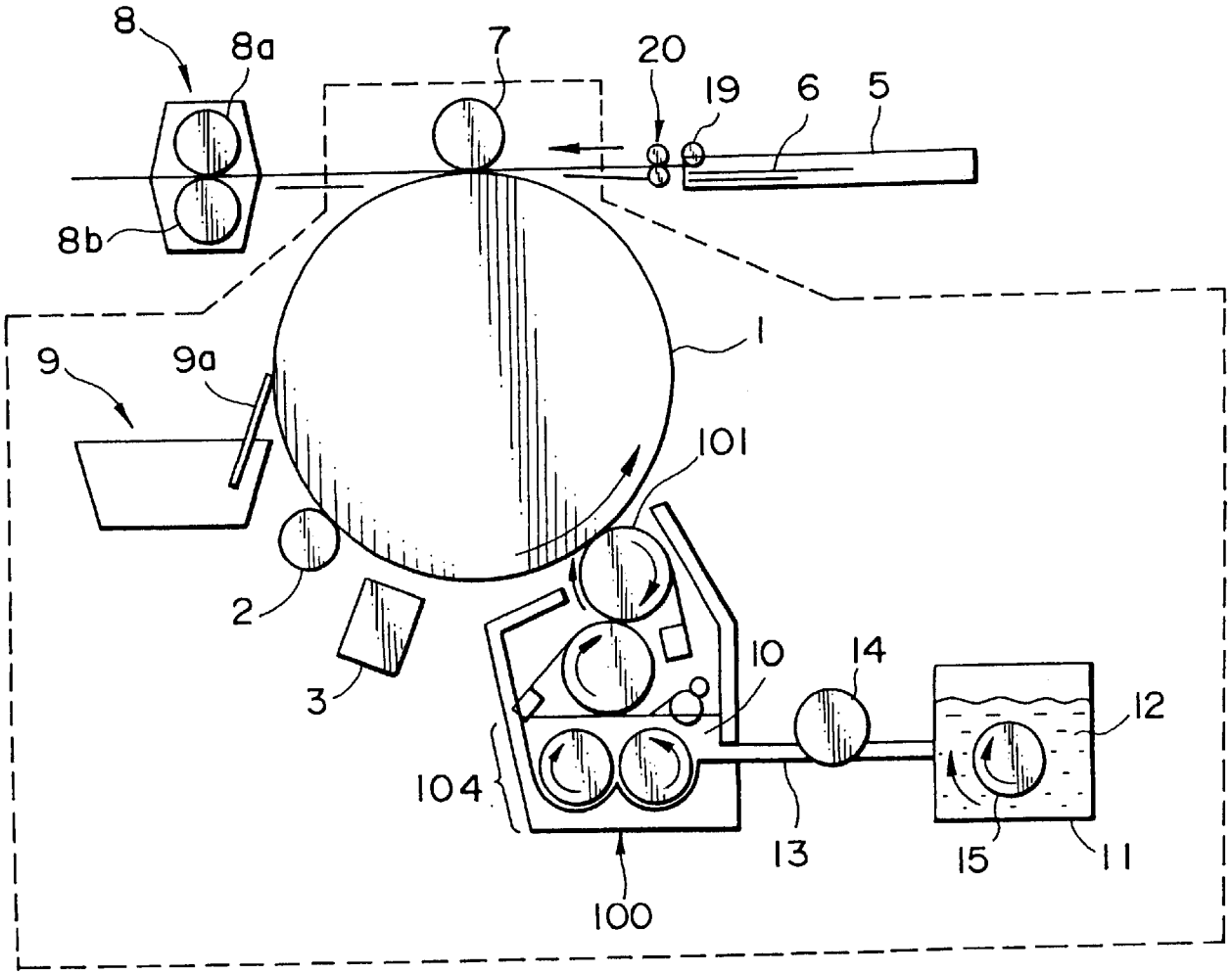
FIG. 2 is a view showing the general construction of a printer to which a first embodiment of the present invention is applied.

When the reservoir 11 shown in FIG. 2 is present, it is preferable to circulate the developing liquid between the liquid storing portion 104 and the reservoir 11. For this purpose, a pipe for causing the liquid to flow from the storing portion 104 to the reservoir 11 may advantageously be provided in addition to the pipe 13 that causes the liquid to flow from the reservoir 11 to the storing portion 104. The circulation successfully reduces irregularities in toner content and viscosity between the reservoir 11 and the storing portion 104. It should be noted that such a circulation scheme requires not only the screws 105 and 106 but also the screw 15 to start rotating before the applicator roller 111.

Figure 5:
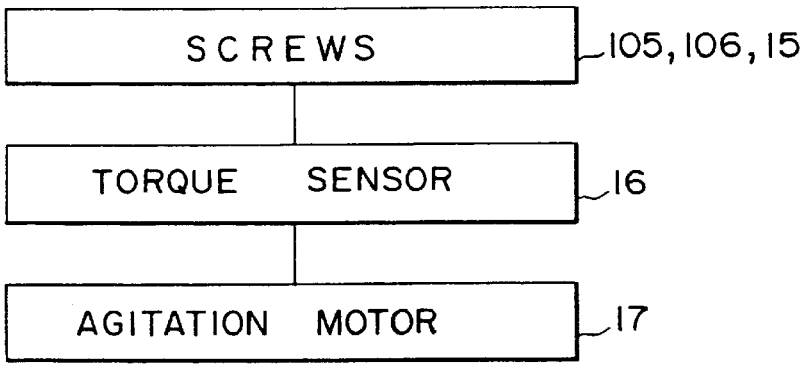
FIG. 5 is a block diagram schematically showing an electrical arrangement relating to screws included in the printer.

The applicator roller 111 should preferably start rotating at a timing allowing the toner contents of the developing liquids 10 and 12 to be surely stabilized and allowing the liquids 10 and 12 to be sufficiently reduced in viscosity. This can be done by determining a period of time of agitation necessary for the viscosity of the toner of the liquids 10 and 12 to decrease to a desired value and which is longer than the spread saturation time of the toner beforehand, and causing the applicator roller 111 to start rotating on the elapse of the above period of time. Alternatively, as shown in FIG. 5, use may be made of a torque sensor or torque sensing means 16 responsive to the output torque of an agitation motor 17 used to drive the screws 105 and 106 or the screw 15. In such a case, the applicator roller 111 will be caused to start rotating after the output torque has reached a preselected value. It is to be noted that the words "desired value" mentioned above is a value lower than $\eta 1$ shown in FIG. 10, [I], ($\eta 0$ hereinafter). This value $\eta 0$ will be described specifically later in relation to a third embodiment of the present invention.

Figure 6:
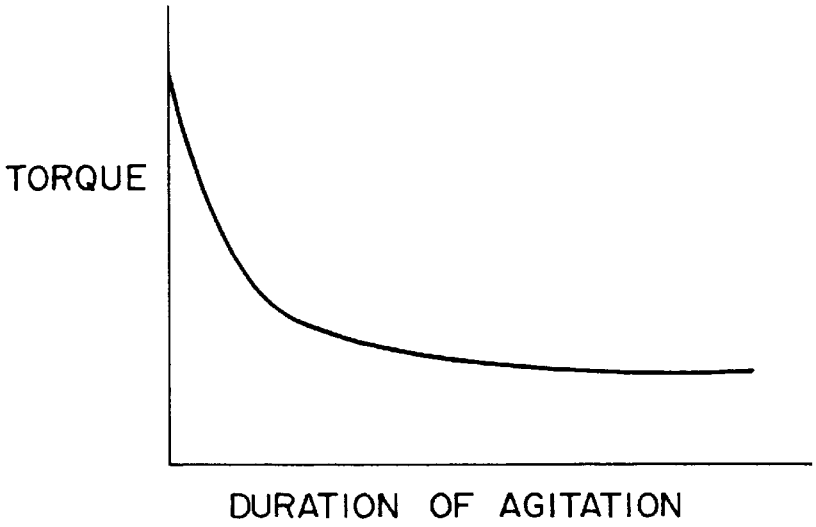
FIG. 6 is a graph showing a relation between the output torque of a motor for driving the screws and the duration of agitation of the developing liquid.

FIG. 6 is a graph showing a relation between the output torque of the agitation motor 17 and the duration of agitation. As shown, a positive correlation exists between the output torque and the viscosity and the degree of toner scattering of the developing liquid. Specifically, when the output torque is high and unstable, the developing liquid has high viscosity with toner being irregularly scattered. When the output torque is low and stable, the developing liquid is lowered in viscosity to saturation with toner being scattered to saturation. It follows that if the applicator roller 111 starts rotating after the output torque has stopped decreasing because of agitation and has become stable, the developing liquid lowered in viscosity to saturation and having a stable toner content can be deposited on the developing roller 111.

Assume that the screws 105 and 106 in the liquid storing portion 104 and the screw 15 in the reservoir 11 both are connected to a single agitation motor 17. Then, the characteristic shown in FIG. 6 is stabilized when the viscosity and toner content are stabilized to saturation in both of the liquids 10 and 12.

On the other hand, assume that the screws 105 and 106 and the screw 15 each are driven by a particular agitation motor 17. Then, the characteristic relating to each motor 17 is stabilized at a particular timing. Which one of such characteristics should be stabilized earlier than the other greatly depends on the amounts of the liquids 10 and 12, the abilities of the agitating members 105, 106 and 15, and the timing for delivering the liquid 12. For example, when the liquid is not circulated between the liquid storing section 104 and the reservoir 11, the liquid 12 in the reservoir 11 decreases in viscosity earlier or later than the liquid 10, depending on its amount remaining in the reservoir 11. It is therefore preferable to assign a particular torque sensor to each motor 17 and to start driving the applicator roller 111 after all the characteristics relating to the motors 17 have been stabilized. However, so long as an arrangement is so made as to stabilize one of the liquids 10 and 12 earlier than the other at all times, the applicator roller 111 may be caused to start rotating only on the basis of the characteristic relating to one motor 17.

The electrophoresis efficiency of toner at the nip for development becomes a maximum when the viscosity of the developing liquid 10 is lowered to saturation. Therefore, when attention is paid only to the electrophoresis efficiency, the applicator roller 111 should preferably start rotating after the liquid 10 in the liquid storing portion 104 has been lowered in viscosity to saturation, i.e., after the output torque has been stabilized. The liquid 10, however, does not bring about short image density or background contamination any longer when its viscosity falls to the viscosity $\eta 0$ that will be described later. Short image density or background contamination can therefore be obviated if the applicator roller 111 is caused to start rotating on the elapse of an agitating time necessary for the viscosity of the liquid 10 to decrease to $\eta 0$ (previously mentioned period of time) or after the actual torque has been lowered to a target torque corresponding to the viscosity $\eta 0$.

Figure 7:
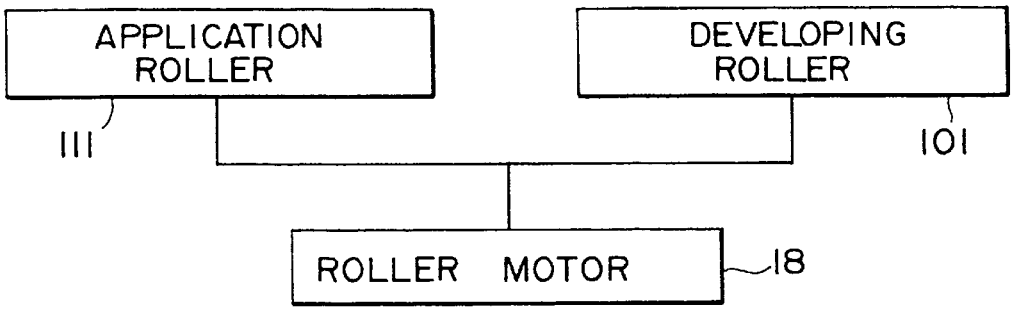
FIG. 7 is a block diagram schematically showing a driveline assigned to a motor for driving a developing roller included in the developing device.

FIG. 7 schematically shows a driveline extending from a development motor 18 to the developing roller 101 and applicator roller 111. As shown, in the illustrative embodiment, the development motor 18 drives both of the developing roller 101 and applicator roller 111. The timing for starting driving the developing roller 101, applicator roller 111 and drum 1 depends on whether or not they contact each other when the printer is not operating. For example, if the drum 1 and developing roller 101 and the developing roller 101 and applicator roller 111 remain in contact with each other in the inoperative state of the printer, it is necessary to start driving all of them at the same time. If the applicator roller 111 is movable into and out of contact with the developing roller 101 and is released from the developing roller 101 in the inoperative state, the applicator roller 111 should only start rotating later than the agitating members and move into contact with the developing roller 101 the drum 1 and developing roller 101 may start rotating at the same time as the agitating members. Further, if the developing roller 101 and drum 1 are movable into and out of contact with each other and are spaced from each other in the inoperative state, at least the developing roller 101 and applicator roller 111 should only start rotating later than the agitating members; the drum 1 may start rotating at the same time as the agitating members.

Referring again to FIG. 1, a greater agitating force acts on the rising portion of the developing liquid 10 than on the other portions. Therefore, in the rising portion, the toner is sufficiently scattered. This, coupled with a sufficient shearing force acting on the rising portion, lowers the viscosity earlier than in the other portions. In the illustrative embodiment, the rising portion of the liquid 10 deposits on the applicator roller 111. That is, the portion of the liquid 10 lowered in viscosity more effectively than the other portions deposits on the developing roller 101.

As stated above, the illustrative embodiment allows the developing liquid 10 with a stable toner content to deposit on the developing roller 101 and thereby prevents image density from being lowered. Because the liquid 10 deposits on the developing roller 101 after having its viscosity lowered, it is not necessary to use high output motors, which would increase the cost and weight of the printer, as the agitation motor 17 and developing motor 18. Further, because sufficient electrophoresis of the toner toward the drum 1 and developing roller 101 occurs at the nip for development, there can be reduced short image density and background contamination ascribable to defective electrophoresis. Moreover, because the drive transmitting members for the agitating members, metering blade 112 and cleaning blades 113 and 110 do not have to be rigid, they also contribute to a decrease in the cost and weight of the printer and reduce defective thickness regulation and defective cleaning of the liquid 10 ascribable to defective contact.

While the illustrative embodiment has concentrated on a printer of the type forming a monocolor toner image, it is similarly applicable to a so-called four drum, tandem full-color image forming apparatus. In this type of apparatus, four identical units each having the arrangement surrounded by a dashed line in FIG. 2 are located side by side between the separator roller pair 20 and the fixing unit 8 and respectively assigned to yellow, magenta, cyan and black. Toner images of four different colors formed by the four units are transferred to a recording medium one above the other, completing a full-color image. When the timing for driving the screws 105 and 106 and the screw 15 is applied to each of the four units, the advantages of the illustrative embodiment are also achievable.

Second Embodiment

Figure 8:
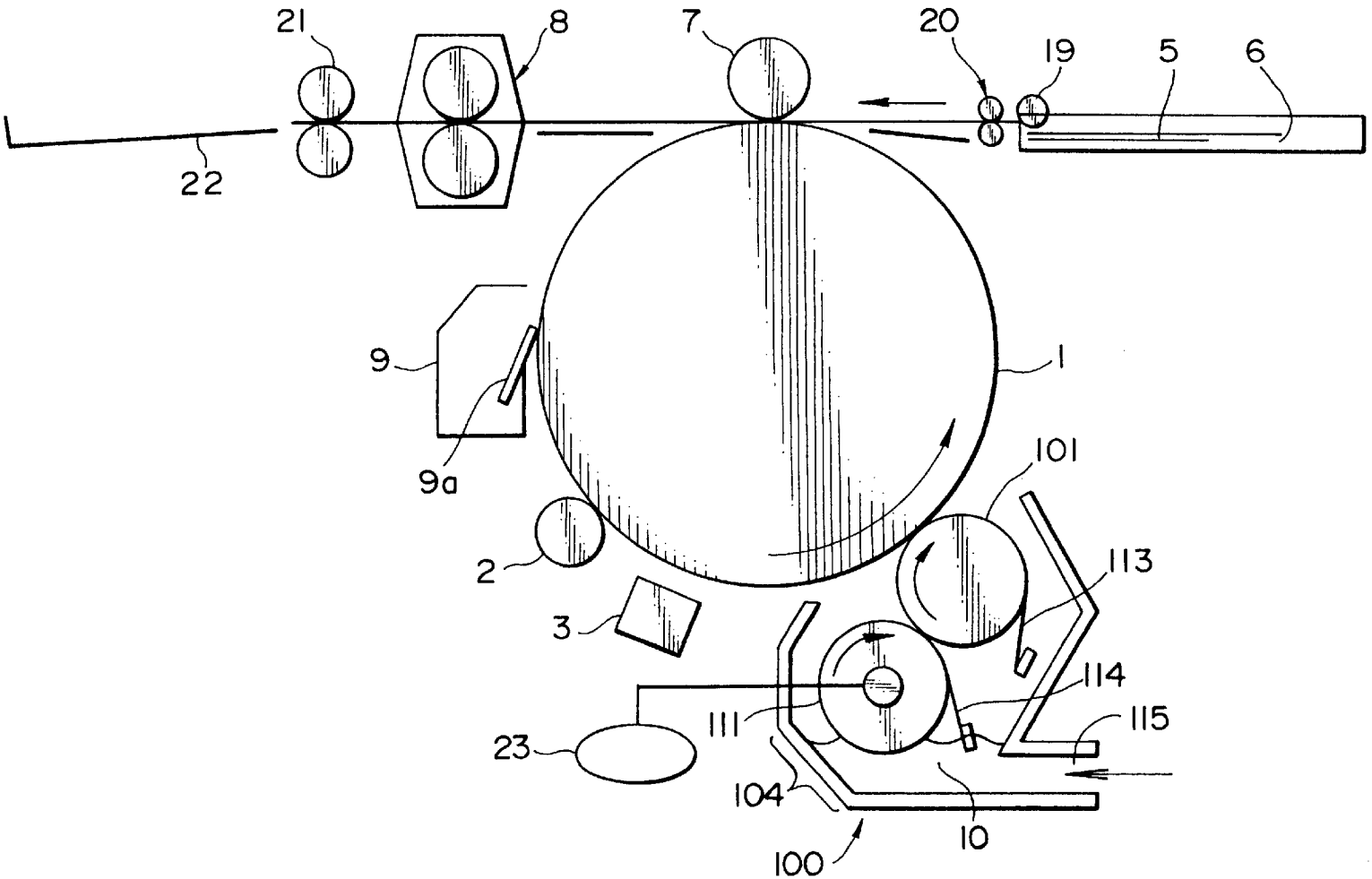
FIG. 8 PRIOR ART
FIG. 8 is a view showing another conventional printer.

Referring to FIG. 8, a printer to which a second embodiment of the present invention is applied will be described. As shown, the developing liquid 10 is introduced into the liquid storing portion 104 via a replenishing port 115 after having its toner content adjusted by a density adjusting section not shown. A fresh developing liquid is replenished from a bottle or container, not shown, to the storing portion 104 via the density adjusting section in an amount making up for consumption, maintaining the amount of liquid in the storing portion 104 substantially constant.

The developing roller or liquid carrier 101 and applicator roller or applying means 111 are rotatable in the liquid storing portion 104. The applicator roller 111 is partly dipped in the developing liquid 10 and rotated by an application motor 23 in a direction indicated by an arrow in FIG. 8. The developing liquid 10 existing in the storing portion 104 is deposited on and scooped up by the applicator roller 111 under conditions dependent on, e.g., the rotation speed of the roller 111 and the viscosity of the liquid 10. The liquid 10 is then transferred from the applicator roller 111 to the developing roller 101 in the form of a thin layer. Consequently, as shown in FIGS. 9A through 9E, the liquid 10 deposits on the surface of the developing roller 101 in the form of a thin layer 10*a* having preselected thickness. The thin layer 10*a* implements sufficient optical density ID when solid toner particles, which will be described later, are transferred from the latent image of the drum 1 to the paper 6.

A cleaning blade 114 is held in contact with the applicator roller 111 for scraping off excess part of the developing liquid 10 scooped up by the applicator roller 111, but not transferred to the developing roller 101. The liquid 10 collected by the cleaning blade 114 is returned to the liquid storing portion 104. In this manner, the liquid 10 is circulated in the developing device 100. For the applicator roller 111, use may be made of a roller having a smooth surface and formed of, e.g., metal or rubber or a photogravure roller whose surface is undulated.

The developing roller 101 adjoins the surface of the drum or image carrier 1 and forms a nip between it and the drum 1. A driveline, not shown, causes the drum 1 to rotate at a preselected speed in a direction indicated by an arrow in FIG. 8. The charge roller 2 uniformly charges the surface of the drum 1. The optical writing unit 3 optically scans the charged surface of the drum 1 in order to form a latent image or image pattern.

The developing roller 101 moves at the same linear velocity as the drum 1 in a direction indicated by an arrow in FIG. 8. When the thin layer 10*a* existing on the developing roller 101 contacts the surface of the drum 1 at the nip for development, so id toner particles contained in the thin layer 10*a* deposit on the latent image and develop it. As a result, a toner image corresponding to the latent image is formed on the drum 1. The cleaning blade 113 held in contact with the developing roller 101 scrapes off excess part of the thin layer 10*a* corresponding in position to the non-image area of the drum 1 and moved away from the nip. This part of the thin layer 10*a* is returned to the liquid storing portion 104.

The pickup roller 19 and separator roller pair 20 feed a single paper 6 from the paper cassette 5 toward the nip for image transfer in synchronism with the rotation of the drum 1 at a preselected timing. The above nip is formed between the drum 1 and the transfer roller 7 movable into and out of contact with the drum 1. When the paper 6 is conveyed via the nip, the toner image carried on the drum 1 (transferred developing liquid 10*b* to be described later) is transferred form the drum 1 to the paper 6. After the fixing unit 8 has fixed the toner image on the paper 6, the paper 6 is driven out to a print tray 22 by an outlet roller pair 21. After the image transfer, the part of the toner image left on the drum 1 (residual developing liquid 10*c* to be described later) is removed from the drum 1 by the cleaning blade 9*a* and then collected in the cleaning unit 9.

Figure 9A:
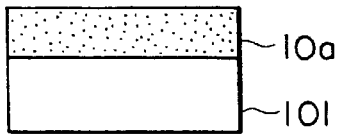
FIGS. 9A through 9E are sections demonstrating the behavior of a thin layer of developing liquid and that of solid toner particles contained therein occurring during an image forming process.

Reference will be made to FIGS. 9A through 9E for describing the behavior of the thin layer 10*a* and that of solid toner particles L3 contained therein. As shown in FIG. 9A, the developing liquid 10 is applied to the developing roller 101 by the applicator roller 111 in 15 the form of the thin layer 10*a*. The thin layer 10*a* has a thickness implementing sufficient optical density ID when the solid toner particles are transferred from the drum 1 to the paper 6, as stated earlier, and is about 10 $\mu$m.

Figure 9B:
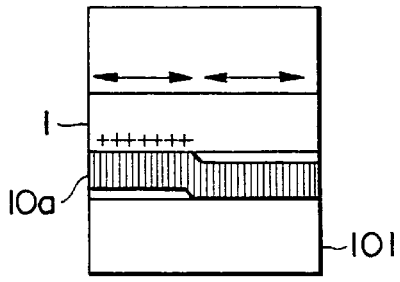

As shown in FIG. 9B, the thin layer 10*a* on the developing roller 101 contacts the drum 1 at the nip for development. As shown, an image area where the latent image or charge pattern is formed and a non-image area where it is not formed exist on the surface of the drum 1. At the nip for development, the solid toner particles contained in the thin layer 10*a* and facing the image area migrate toward the drum 1 while the particles facing the non-image area migrate toward the developing roller 101. FIG. 9B shows positive-to-positive development in which the toner particles contained in the thin layer 10*a* are negatively charged. In the case of negative-to-positive development, a charge pattern is formed in the non-image area of the drum 1. In any case, the toner particles migrate toward the drum 1 in the image area and migrate toward the developing roller 101 in the non-image area.

Figure 9C:
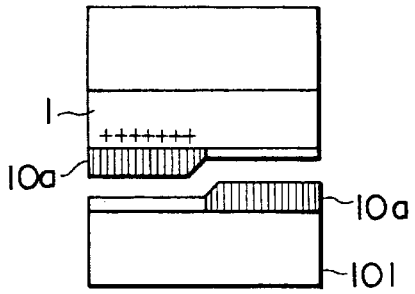

As shown in FIG. 9C, the developing roller 101 is released from the drum 1 after conveying the thin layer 10*a* away from the nip. As shown, the thin layer 10*a* is separated such that a great amount of toner particles deposit on the image area of the drum 1, but a small amount of toner particles deposit on the non-image area in a thinner layer than on the image area. On the developing roller 101, the thin layer 10*a* is separated in the opposite relation to the thin layer 10*a* on the drum 1.

Figure 9D:
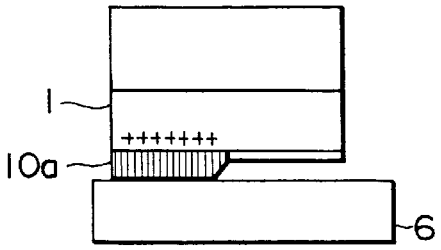

As shown in FIG. 9D, the paper 6 contacts the thin layer 10*a* transferred from the developing roller 101 to the drum 1. While the paper 6 is shown as not contacting the non-image area of the drum 1, the paper 6, in practice, contacts even the non-image area due to the electric field formed in the nip for image transfer and the pressure of the transfer roller 7 or similar pressing member.

Figure 9E:
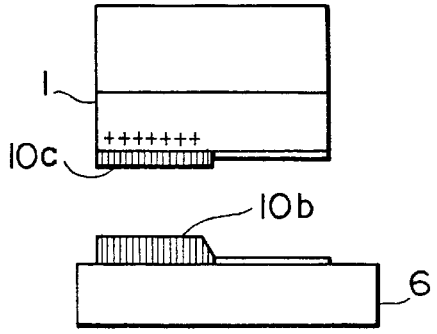

As shown in FIG. 9E, the paper 6 moved away from the nip for image transfer is released from the drum 1. Generally, as for the transfer ratio of the thin layer 10*a* to the paper 6, the transferred developing liquid 10*b* transferred to the paper 6 is greater in weight or in the amount of solid toner particles than the residual developing liquid 10*c* left on the drum 1 due to the electric field of the nip, although the ratio depends on the characteristic of the developing liquid 10.

The developing liquid 10 used in the printer of FIG. 8 also has a viscosity characteristic dependent on a shearing force.

Figure 10:
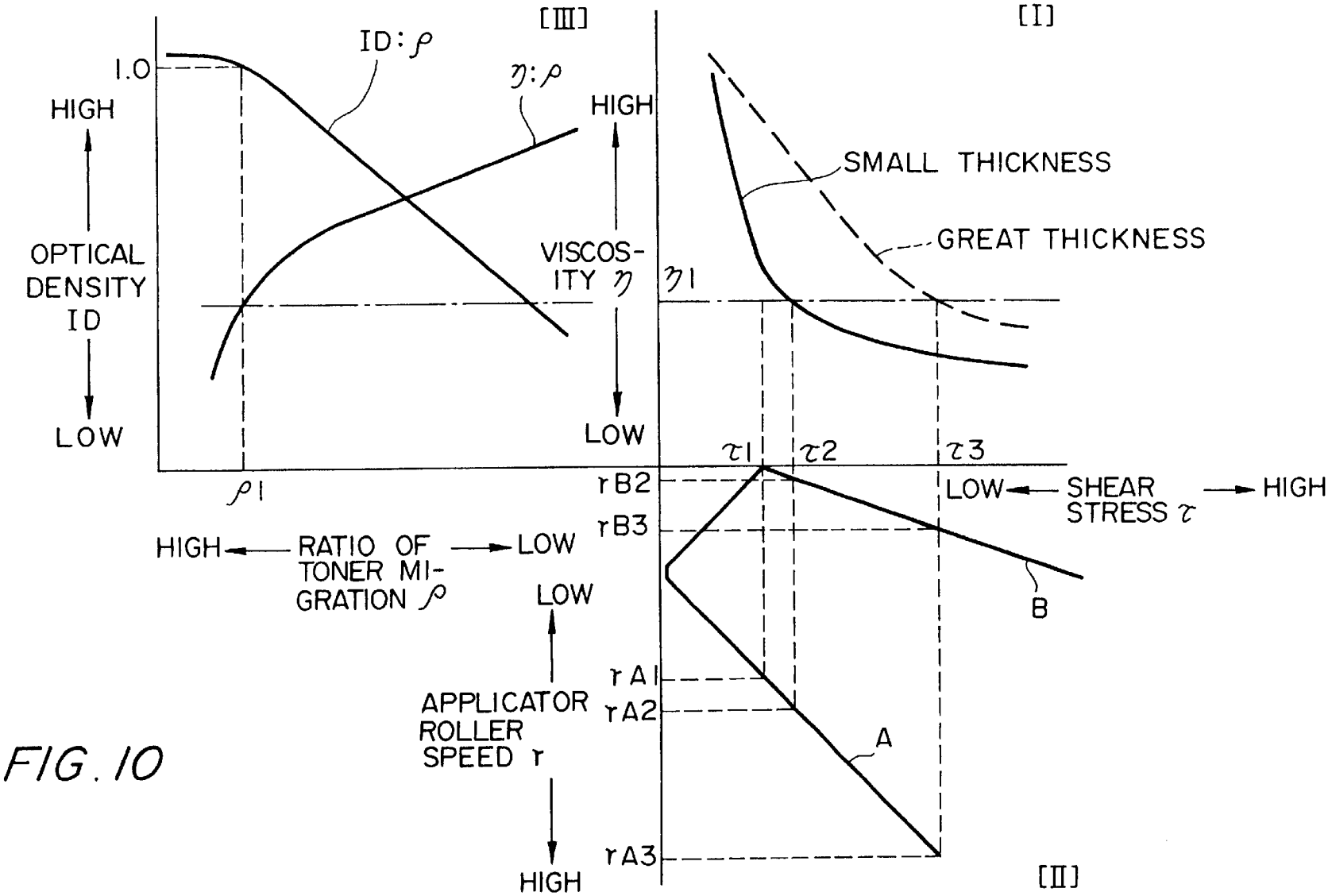
FIG. 10, [I], is a graph showing a relation between the viscosity of a developing liquid and the shear stress.

The influence of the viscosity $\eta$ of the developing liquid 10 on the steps shown in FIGS. 9A through 9C will be described hereinafter. FIG. 10, [III], is a graph showing a relation between the viscosity $\eta$ and the ratio of toner migration $\rho$ occurring at the nip for development, and a relation between the ratio $\rho$ and the optical density ID of an image. In FIG. 10, [III], the left ordinate and right ordinate respectively indicate the optical density ID and viscosity $\eta$ while the abscissa indicates the ratio of toner migration $\rho$. The words "ratio of toner migration $\rho$" refer to, as for the image area, the ratio of toner particles migrated from the developing roller 101 toward the drum 1 in the condition shown in FIG. 9B or, as for the non-image area, the ratio of toner particles migrated from the drum 1 toward the developing roller 101. FIG. 10, [III], indicates that the toner in the thin layer 10*a* does not move toward the drum 1 by electrophores is unless the viscosity $\eta$ of the developing liquid 10 nipped between the developing roller 101 and the applicator roller 111 at the applying position is reduced to a certain value.

The influence of the ratio of toner migration $\rho$ in the steps shown in FIGS. 9D and 9E is as follows. The relation between the optical density ID and the ratio of toner migration $\rho$ shown in FIG. 10, [III], is determined in constant image transfer conditions and shows that the optical density ID decreases with a decrease in the ratio of toner movement $\rho$. The optical density ID is the density of the toner image transferred to the paper 6 and determines the final image quality of the paper 6.

To determine the ratio of toner migration $\rho$, the toner (containing a small amount of carrier liquid) transferred to the image area of the drum 1 and the developing liquid 10 left on the developing roller 101 moved away from the nip for development may be collected over the same area and then weighed. Another specific procedure is collecting a suitable amount of toner moved to the drum 1 and a suitable amount of liquid 10 left on the developing roller 101 moved away from the nip, then sandwiching each of the toner and liquid between a particular pair of transparent glass sheets in the same conditions, then measuring the reflection density or the transmission density, and then determining a ratio between the results of measurement.

By a series of extended researches and experiments, the inventors found that the printer shown in FIG. 8 had the following problem left unsolved. The viscosity of the developing liquid 10 cannot be sufficiently lowered while the liquid 10 is conveyed from the storing portion 104 to the nip for development, depending on conditions in which the developing roller 101 and applicator roller 111 are operated. As a result, short image density and background contamination are apt to occur. The above conditions include the ratio in linear velocity between the developing roller 101 and the applicator roller 111 and the directions of rotation of the rollers 101 and 111. These conditions will be described specifically hereinafter.

The upper plate A and lower plate B shown in FIG. 3 correspond to the applicator roller 111 and developing roller 101, respectively. The distance between the two plates A and B corresponds to the thickness of the thin layer 10*a* formed on the developing roller 101. FIG. 10, [I], shows a relation between the shear stress $\tau$ and the viscosity $\eta$ of the liquid 10 which is dependent on a shearing force. As shown, for a given developing liquid 10, the above relation slightly varies in accordance with the thickness of the liquid 10 applied to the developing roller 101.

Considering the shear stress $\tau$ in relation to the developing device 100, FIG. 8, FIG. 10, shows a relation between the rotation speed r of the applicator roller 111 and the shear stress $\tau$. More specifically, FIG. 10, is a graph showing a relation between the rotation speed r of the applicator roller 111 and the shear stress X acting on the thin layer 10*a*, as determined when the developing roller 101 was rotated at a constant speed. For example, the developing roller 101 is rotated at a speed equal to the rotation speed rA1 of the applicator roller 111 shown in the graph. In FIG. 10, a line B indicates a relation between the rotation speed r and the shear stress $\tau$ occurring when the axis of the developing roller 101 and that of the applicator roller 111 rotate in the same direction (forward). A curve shown in FIG. 10, shows a relation between the rotation speed r and the shear stress $\tau$ occurring when the above axes rotate in opposite directions to each other (reverse). In FIG. 10, why a shear stress $\tau$ occurs even when the rotation speed r of the applicator roller 111 is zero is that the developing roller 101 rotates at the same speed rA1 as the applicator roller 111. It follows that when the rotation speed of the developing roller 101 varies, the line B and curve B vary in slope or shift in the right-and-left direction in FIG. 10. It is to be noted that "Applicator Roller Speed r" on the ordinate of FIG. 10, may be translated into a lower plate speed. The shear stress $\tau$ on the abscissa of FIG. 10, is related to the difference in speed between the surface of the developing roller 101 and that of the applicator roller 111. That is, the shear stress T increases with an increase in the above difference in speed.

The line B of FIG. 10. [II], is representative of a characteristic determined when the axis of the developing roller 101 and that of the applicator roller 111 are rotated in the same direction, as stated above. In this condition, the surfaces of the two rollers 101 and 111 facing each other move in opposite directions to each other. At this instant, at the applying position, a stress acts in such a manner as to cause part of the developing liquid 10 adjoining the roller 101 and the other part adjoining the roller 111 to move in opposite directions to each other. The difference in speed (relative position on the abscissa of FIG. 10, [II]) increases with an increase in the rotation speed r of the applicator roller 111.

As for the curve A of FIG. 10, [II], the above two surfaces facing each other at the applying position move in the same direction as each other, so that a stress tending to cause the above two parts of the developing liquid 10 to move in the same direction acts. At this instant, the developing roller 101 is rotating at the speed rA1 shown in FIG. 10, [II]. Therefore, in the range where the rotation speed r of the applicator roller 111 is lower than rA1, the difference in speed between the surfaces and therefore the shear stress $\tau$ increases with a decrease in rotation speed r. In the range where the rotation speed r is higher than rA1, the difference in speed and therefore the shear stress $\tau$ increases with an increase in rotation speed r. Further, when the rotation speed r is equal to rA1, the difference in speed is close to zero while the shear stress $\tau$ is substantially zero. Consequently, the curve A resembles a symbol "<". As for the curve A, in the speed range of the applicator roller 111 where the rotation speed r is higher than zero, but lower than rA1, only a shear stress lower than the shear stress obtainable when the applicator roller 111 is not rotated is achievable, despite the rotation of the roller 111. It is therefore not desirable to rotate the applicator roller 111 in such a speed range when importance is attached to energy saving and the reduction of viscosity of the liquid 10.

As shown in FIG. 10, [II], for a given rotation speed r of the application roller 111, a higher shear stress $\tau$ is achievable with the characteristic represented by the line B than with the characteristic respected by the curve A. Therefore, from the low viscosity standpoint, it is desirable to rotate the axis of the developing roller 101 and that of the applicator roller 111 in the same direction.

The desirable optical density ID on the paper 6 is 1.0 or above, as seen in FIG. 10, [III]. As the relation between the viscosity $\eta$ and the ratio of toner migration $\rho$ shown in FIG. 10, [III], indicates, a ratio of toner migration implementing the optical density ID of 1.0 or above is higher than $\rho$1. As FIG. 10, [I], indicates, to implement the ratio $\rho$ higher than $\rho$ 1, the viscosity $\eta$ of the thin layer 10*a* must be lower than $\eta$1. Further, to provide the thin layer 10*a* with viscosity lower than $\eta$1 while making the thin layer 10*a* relative thin, there is needed a shear stress of $\tau$2 or above corresponding to a point where a solid curve shown in FIG. 10, [I], intersects a dashed line representative of the viscosity $\eta$1.

In FIG. 10, [II], while the applicator roller 111 is in a halt, only a shear stress $\tau$ lower than $\tau$1, which is lower than $\tau$2, is available with both of the curve A and line B. As for the curve A, a shear stress $\tau$ of 2 or above is achievable only when the developing roller 101 is rotated at a speed rA2 far higher than rA1. As for the line B, the above shear stress $\tau$ is achievable when the applicator roller 111 is rotated at a speed rB2 far lower than rA1.

To provide the thin layer 10*a* with viscosity lower than $\eta$1 while making the thin layer 10*a* relative thick, there is needed a shear stress $\tau$ of $\tau$3 or above corresponding to a point where a dotted curve shown in FIG. 10, [I], intersects a dashed line representative of the viscosity $\eta$1. To achieve such a sear stress $\tau$, the applicator roller 111 must be rotated at a speed of rA3 or above on the curve A or a speed of rB3 or above on the line A.

The direction of rotation of the developing roller 101 should preferably be selected on the basis of the direction of rotation of the drum 1. Specifically, in the printer using the electrophoresis of the toner, the axis of the drum 1 and that of the developing roller 101 should preferably rotate in opposite directions to each other in order to efficiently guarantee a period of time for electrophoresis at the nip for development, as shown in FIG. 8. This causes the surface of the roller 101 and that of the drum 1 facing each other to move in the same direction as each other. Consequently, a period of time over which the thin layer 10*a* moves through the nip is successfully increased, compared to the case wherein the above surfaces move in opposite directions to each other.

On the other hand, the rotation speed of the developing roller 101 must be delicately set in consideration of the ratio in linear velocity between the roller 101 and the drum 1; otherwise, the developing ability of the developing device 100 would be too low to effect adequate development.

For the above reasons, the viscosity of the developing liquid 10, as measured at the applying position, should preferably be lowered on the basis of the direction and speed of rotation of the applicator roller 111.

Assume that the axis of the developing roller 101 and that of the applicator roller 111 must be rotated in opposite directions to each other for one reason or another. Then, even when a thin liquid layer is formed, the optical density ID of 1.0 is not achievable unless the applicator roller 111 is rotated at a relatively high speed r of rA2 (see the curve A, FIG. 10, [II]). FIG. 10, [II], shows the characteristic of a particular developing liquid exhibiting a preselected raised saturation viscosity. When use is made of a developing liquid whose raised saturation viscosity is far higher than the above raised saturation viscosity, the optical density ID of 1.0 is not achievable unless the applicator roller 111 is rotated at a higher rotation speed r. Therefore, even if the axis of the developing roller 101 and that of the applicator roller 111 are rotated in the same direction, even the speed rB2 shown in FIG. 10, [11], is relatively high when it comes to a developing liquid having a raised saturation density.

However, the above relatively high rotation speed r of the applicator roller 111 is likely to scatter the developing liquid 10 existing on the applicator roller 111 or to make it difficult to form the thin layer 10*a* having a desired thickness.

Figure 11:
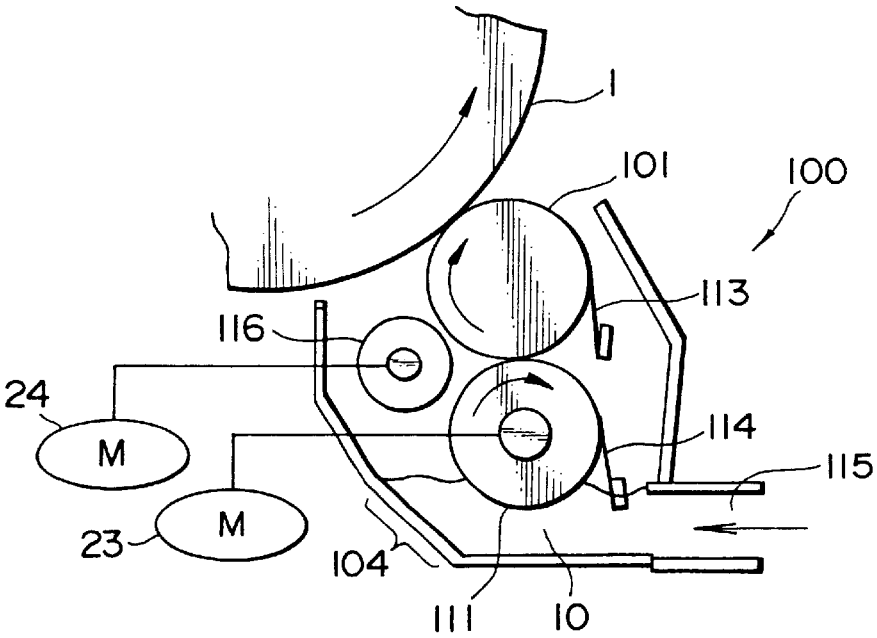
FIG. 11 is a section showing a developing device included in a printer which a second embodiment of the present invention is applied.

The illustrative embodiment solves the above problem and implements a low viscosity of the developing liquid 10 with the following unique configuration. FIG. 11 shows essential pat of a printer representative of the illustrative embodiment. In FIG. 10, structural elements identical with the structural elements shown in FIG. 8 are designated by identical reference numerals and will not be described in order to avoid redundancy.

As shown in FIG. 11, the developing device 100 includes a roller or thin layer contact member 116 contacting the thin layer 10*a* formed on the developing roller 101. The roller 116 is positioned upstream of the nip where the thin layer 10*a* contacts the drum 1 in the direction of movement of the developing roller 101. The roller 116 exerts a shearing force on the thin layer 10*a*. A roller motor 24 causes the roller 116 to rotate in a preselected direction.

The developing liquid 10 is provided with a preselected toner content by a density adjusting section, not shown, and then introduced into the liquid storing portion 104 via the replenishing port 115, as in the developing device of FIG. 8. More specifically, the liquid 10 has a toner content selected to form the thin layer 10*a*, which is as thin as possible, and to implement the optical density ID of 1.0 or above on the paper 6 when the ratio of toner movement ρ is high, as described with reference to FIG. 10.

The applicator roller 111 scoops up the above developing liquid 10 and causes it to form the thin layer 10*a* on the developing roller 101. The roller 116 located upstream of the nip for development in the direction of movement of the developing roller 101 contacts the surface of the thin layer 10*a* and exerts a shearing force thereon to thereby reduce the viscosity of the thin layer 10*a*. This increases the ratio of toner migration ρ of the thin layer 10*a* and allows a toner image realizing the optical density ID of 1.0 or above to be formed on the drum 1. The toner image is transferred from the drum 1 to the paper 6 by the previously stated process. The toner image with the optical density ID of 1.0 or above has extremely high quality.

In FIG. 11, the axis of the roller 116 and that of the applicator roller 111 rotate in the same direction as each other. Therefore, a relation between the viscosity η of the developing liquid 10 and the rotation speed of the roller 116, as measured at the applying position, is close to the relation represented by the line B of FIG. 10, [II]. However, in the illustrative embodiment, the developing liquid 10 has a higher raised saturation viscosity than the developing liquid having the characteristic represented by the line B. Therefore, should the applicator roller 111 be rotated at the adequate speed r capable of preventing the liquid 10 from scattering about and stablizing the thickness of the thin layer 10*a*, the viscosity η of the thin layer 10*a* would exceed η1. In light of this, the roller 116 exerts an additional shearing force on the liquid 10 forming the thin layer before the thin layer 10*a* reaches the nip for development, thereby lowering the viscosity to η1 or η lower than η1.

Figure 12:
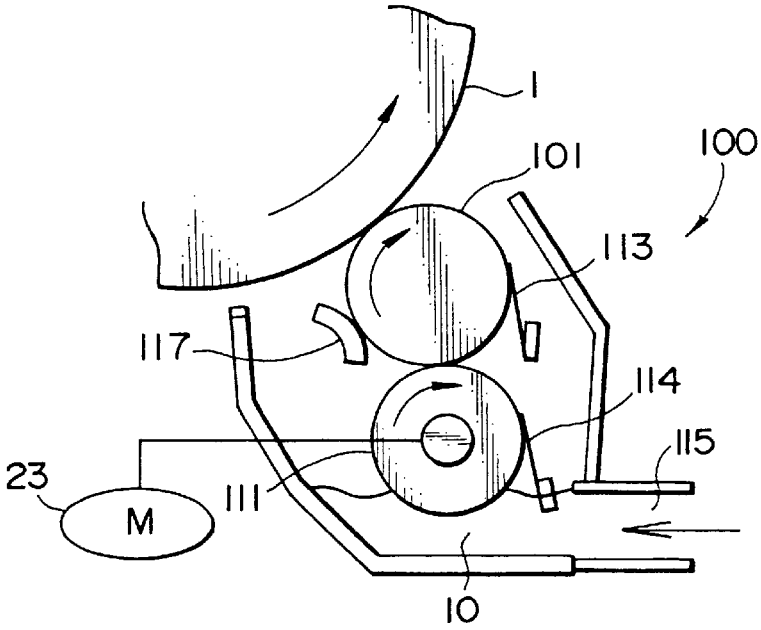
FIG. 12 is a section showing another specific configuration of the developing device.

FIG. 12 shows a modification of the above developing device 100. As shown, the roller 116 serving as a thin layer contact member is replaced with an arch member 117. The arch member 117 is effective to provide the thin layer 10*a* with a viscosity lower than η1 when the rotation speed of the developing roller 101 is relatively high. This is because when the rotation speed of the developing roller 101 increases, the shear stress τ1 occurring when the rotation speed r of the applicator roller 111 is zero, as shown in FIG. 10, [II], shifts to the right and implements the viscosity η1 shown in FIG. 10, [I]. Because the moving speed of the surface of the arch member 117 is zero, the rotation speed of the developing roller 101 that allows the shear stress τ1 to implement the viscosity η1 at the zero rotation speed r, FIG. 10, [I] is the speed that implements the viscosity η1 with the arch member 117.

The developing device 100 shown in FIG. 12 does not need drive means for driving the arch member or thin layer contact member 117 and is therefore simpler in construction than the developing device 100 shown in FIG. 11. Further, the arch member 117 may play the role of the regulating member for regulating the thickness of the developing liquid 10 deposited on the developing roller 117, in which case the applicator roller 111 will be omitted. More specifically, the developing roller 101 may be dipped in the liquid 10 existing in the liquid storing portion 104 without the intermediary of the applicator roller 111. In this case, however, the viscosity of the liquid 10 sometimes cannot be lowered to the desired value unless the developing roller 101 is rotated at a high speed. Therefore, when the developing roller 101 is dipped in the liquid 10, it is desirable to provide the developing device 100 with a thin layer contact member bifunctioning as a regulating member and a thin layer contact member exerting a shearing force on the thin layer 10*a* regulated in thickness.

It is to be noted that the thin layer contact member exerts a shearing force on the thin layer 10*a* formed on the developing roller or liquid carrier 101. In this sense, the applicator roller Ill exerting a shearing force on the developing liquid 10 being applied to the developing roller 101 is not a thin layer contact member. However, the applicator roller 111 is a specific form of a mechanism for exerting a shearing force on the liquid 10 at a position upstream of the developing position or nip on the route extending from the liquid storing portion 104 to the developing position via the feeding device. This mechanism will be described in relation to the following third embodiment of the present invention.

Third Embodiment

A printer to which a third embodiment of the present invention is applied will be described hereinafter. The printer to be described is basically identical in configuration with the printer of the first embodiment and will not be described specifically. Arrangements unique to the third embodiment will be described with reference to FIG. 4.

In the developing device 100 shown in FIG. 4, the screws 105 and 106 exert a shearing force on the developing liquid 10 in the liquid storing portion 104 in order to lower the viscosity of the liquid 10, as stated earlier. Also, because the developing device 100 includes the applicator roller 111, the viscosity of the liquid 10 is lowered at the applying position between the developing roller 101 and the applicator roller 111, as described with reference to FIGS. 10, [I], [II] and [III]. In addition, the viscosity of the liquid 10 is lowered by a shearing force when the liquid 10 is brought to the regulating position.between the applicator roller 111 and the metering blade 112, as shown in FIG. 3. The developing device 100 therefore includes a mechanism for exerting a shearing force on the liquid 10 at a position upstream of the nip for development on the route extending from the liquid storing portion 104 to the nip via the applicator roller 111, applying position, and developing roller 101. This mechanism is implemented by the screws 105 and 106, the applying mechanism located at the applying position, and the regulating mechanism located at the regulating position.

In the developing device 100 including the above mechanism, even if the viscosity $\eta$ of the developing liquid 10 is higher than $\eta$1 that implements the optical density ID of 1.0 or above, it sometimes falls below $\eta$1 when the liquid 10 is brought to the nip for development. Specifically, as for the viscosity $\eta$ of the liquid 10 in the liquid storing portion 104, assume that the viscosity that provides the thin layer 10*a* reached the nip with the viscosity $\eta$1 is $\eta$0. Then, if the raised saturation viscosity of the liquid 10 is lower than or equal to $\eta$0 in the developing device 100 of FIG. 4, the viscosity $\eta$ of the thin layer 10*a* is lower than or equal to $\eta$1 at the nip without fail. In this condition, even if the viscosity of the liquid 10 is increased to saturation in the liquid storing portion 104, it is necessarily lowered to $\eta$1 or below on the route to the nip. It follows that if the raised saturation viscosity of the liquid 10 is lower than or equal to $\eta$0, it is possible to obviate short image density and background contamination ascribable to short electrophoresis of the toner without driving the screws 105 and 106 in advance as in the first embodiment.

Assume that the developing device 100 does not satisfy the condition that the raised saturation viscosity of the developing liquid 10 be lower than or equal to $\eta$0. Then, the screws 105 and 106 may be driven before the applicator roller 111 in order to lower the viscosity of the liquid 10 in the liquid storing portion 104 to $\eta$0. If a mechanism for selectively causing the drum 1 and developing roller 101 to contact each other is provided, the thin layer 10*a* may be lowered in viscosity to $\eta$1 at the nip without requiring the screws 105 and 106 to be driven in the above manner. This mechanism will be described later in detail.

In the illustrative embodiment, the kind of the developing liquid 10 to be used with the printer is specified by the manufacturer or the distributor of the printer. For example, an operation manual delivered to the user together with the printer includes a message "Use a developing liquid X available from a company Y." The specification of the shearing force exerting mechanism is set such that so long as the printer is operated with the liquid 10 of the specified kind, the raised saturation viscosity remains lower than or equal to $\eta$0. The above specification includes contact pressure, number of rotations, and rotation speed. In this condition, even if the viscosity $\eta$ of the liquid 10 in the liquid storing portion 104 is as high as the saturation level, it can be surely lowered to $\eta$ 1 or below before the liquid reaches the nip for development.

Why the viscosity of the thin layer 10*a* of $\eta$1 or below, as measured at the nip for development, obviates short image density and background contamination ascribable to short electrophoresis of the toner will be described hereinafter. When the thin layer 10*a* is brought to the nip, it is sandwiched between the surface of the developing roller 101 and that of the drum 1. At this instant, the toner existing in the surface portion of the thin layer 10*a* deposits on the surface of the drum 1 while the toner existing in the bottom portion of the same remains on the surface of the developing roller 101. While the thin layer 10*a* is being conveyed through the nip, the toner moves due to electrophoresis in the direction of thickness of the thin layer 10*a*, forming a toner image or a non-image area on the drum 1.

At the time of electrophoresis, the toner existing on the developing roller 101 should migrate as far as the surface of the drum 1. Should the viscosity of the thin layer 10*a* be too high to prevent the toner from reaching the drum 1, the toner would remain on the developing roller 101 and make image density short. On the other hand, the toner deposited on the drum 1 should migrate as far as the surface of the developing roller 101 by electrophoresis. Should the viscosity of the thin layer 10*a* be too high to prevent such toner from reaching the developing roller 101, the toner would remain on the drum 1 and bring about background contamination. By lowering the viscosity $\eta$ of the liquid 10 to $\eta$1 or below, it is possible to cause toner at the nip to sufficiently migrate due to electrophoresis to such a degree that the toner does not remain in the non-image area of the drum 1 moved away from the nip or in the portion of the developing roller 101 moved away from the nip and corresponding to the image area of the drum 1. This successfully obviates short image density and background contamination ascribable to short electrophoresis of the toner.

It should be noted that the route extending from the liquid storing portion 104 to the developing position via the feeding device refers to the shortest route between the liquid storing portion 104 and the developing position. Should the viscosity of the developing liquid 10 conveyed via the shortest route be not as low as $\eta$1, the liquid 10 would bring about short image density and background contamination. In FIG. 4, the route on which the liquid 10 is scraped off by the metering blade 112 at the regulating position and again deposited on the applicator roller 111 and conveyed to the nip thereby is not included in the route. Also, the route on which the liquid left on the applicator roller 111 moved away from the applying position and again brought to the developing position via the applying position is not included in the above route.

More specifically, the shortest route in FIG. 4 extends from the liquid storing portion 104 to the nip for development via the rising portion of the developing liquid 10, applicator roller 111, regulating position, and applying position. While FIG. 4 illustrates the condition wherein the surface of the liquid 10 in the liquid storing portion 104 partly rises due to the rotation of the screws 105 and 106, the surface of the liquid 10 remains flat when the screws 105 and 106 are not rotated. Therefore, even if the screws 105 and 106 and applicator roller 111 start rotating at the same time, the liquid 10 in the liquid storing portion 104 does not immediately deposit on the applicator roller 111. That is, the liquid 10 deposits on the applicator roller 111 only when the surface of the liquid 10 rises due to the rotation of the screws 105 and 106, as illustrated in FIG. 4. It follows that if the liquid 10 is conveyed via the shortest route, the screw members 105 and 106 exert a shearing force on the liquid 10 without fail.

Figure 13:
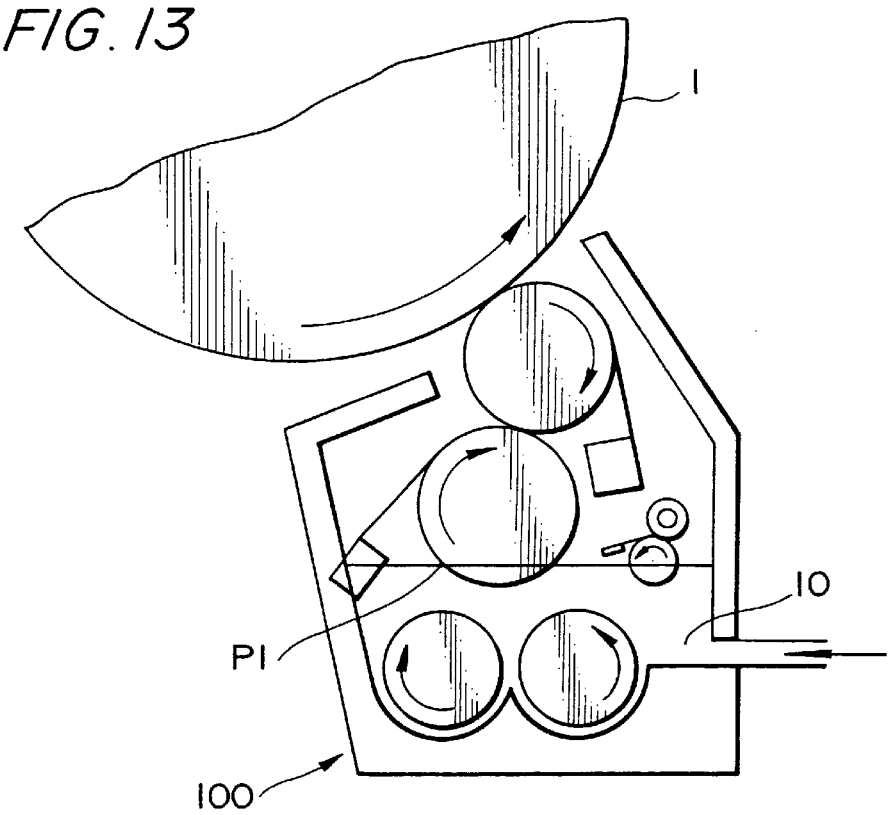
FIG. 13 is a section showing a modification of a developing device included in a printer to which a third embodiment of the present invention is applied.

FIG. 13 shows the developing device 100 in which the liquid level in the liquid storing portion 104 is higher than the liquid level of FIG. 4. As shown, when the screws 105 and 106 are not rotated, the applicator roller 111 is partly dipped in the developing liquid 10. The shortest route therefore begins at a point P1 where the surface of the liquid 10 and the circumference of the applicator roller 111 contact each other. In this configuration, when the screws 105 and 106 and applicator roller 111 start rotating at the same time, the liquid 10 existing at the above point P1 deposits on the applicator roller 111 and is conveyed to the nip thereby without the screws 105 and 106 exerting a shearing force on the liquid 10. The screws 105 and 106 therefore cannot exert a shearing force on the liquid 10 on the shortest route and, in this sense, does not belong to the shearing force exerting mechanism.

However, even in the arrangement of FIG. 13, the screws 105 and 106 may form part of the shearing force exerting mechanism, as follows. For example, assume that a mechanism is provided for bodily moving the developing device 100 into and out of contact with the drum 1 in the up-and-down direction as seen in FIG. 13, and that the mechanism releases the former from the latter in the stand-by state. Then, the nip for development is formed when the drum and developing roller 101 contact each other. If the thin layer 10*a* on the developing roller 101 is conveyed via the applying position, e.g., two times before the formation of the above nip, the shortest route for the developing liquid 10 is noticeably sophisticated, compared to the simple route extending from the liquid surface to the nip via the applicator roller, regulating position, and applying position. More specifically, the liquid 10 at the leading edge is conveyed from the liquid surface to the applying position via the applicator roller and regulating position and then returned to the applying position. At this instant, the liquid existing on the applicator roller 111 and provided with a shearing force by the screws 105 and 106 is introduced into the above liquid 10. As a result, the leading edge of the thin layer 10*a* brought to the nip contains the liquid 10, if a little, subjected to the shearing force exerted by the screws 105 and 106. That is, the screws 105 and-106 constitute part of the shearing force exerting mechanism.

Figure 14:
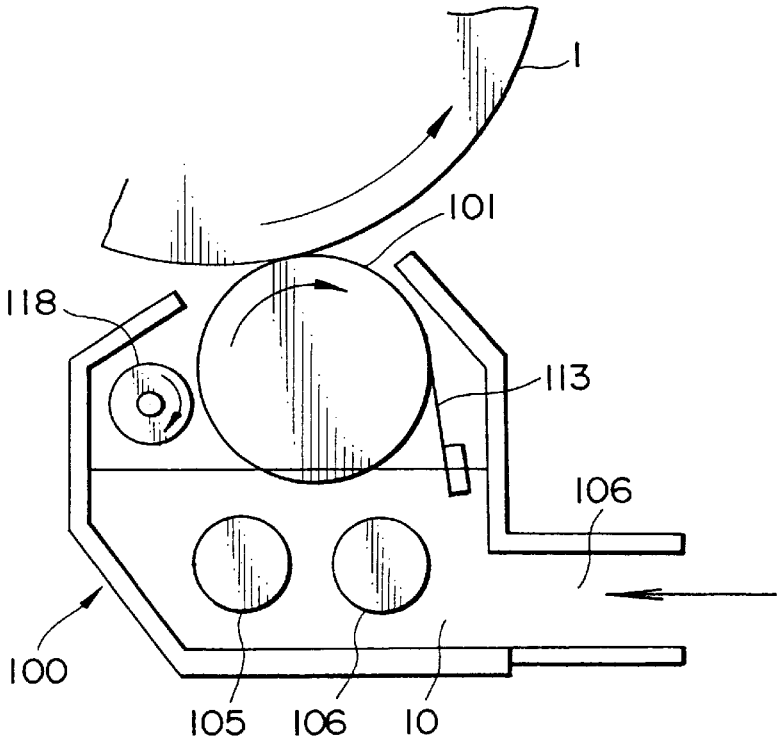
FIG. 14 is a section showing another modification of the printer.

FIG. 14 shows a specific configuration of the developing device 100 in which the shearing force exerting mechanism does not include an applicator roller. As shown, the developing device 100 does not include an applicator roller. The developing roller 101 is directly dipped in the developing liquid 10 existing in the developing device 100. A regulating roller 118 is located at one side of the developing roller 101 and caused to rotate in a direction indicated by an arrow in FIG. 14 by a drive source (not shown). The regulating roller 118 regulates the thickness of the liquid 10 scooped up from the storing portion 104 by the developing roller 101, thereby causing the liquid 10 to form the thin layer 10*a*. At this instant, a shearing force is exerted on the liquid 10 in order to lower its viscosity. Although the regulating roller 118 resembles the roller 116 shown in FIG. 11, the roller 118 does not play the role of the thin layer contact member because it exerts a shearing force on the liquid 10 being regulated, i.e., not forming a complete thin layer.

The thin layer 10*a* should preferably have a thickness capable of forming an image with optical density of 1.0 to 1.8 when the viscosity is $\eta 1$. With such a thickness range, it is possible to prevent a transferred image from blurring while obviating short image density and background contamination. We found that the thin layer 10*a* capable of forming an image with optical density above 1.8 caused an excessive amount of carrier to deposit on the drum 1 and aggravated the blur of an image.

It is to be noted that the indication of the kind of the developing liquid 10 is not limited to a message included in, e.g., an operation manual. For example, a serviceman or similar person may be sent to the user's station without fail when an image forming apparatus is to be used for the first time, for setting a developing liquid in the apparatus and then asking the user to use a developing liquid identical with the above liquid.

While the illustrative embodiments have concentrated on a developing liquid consisting of toner and carrier liquid, the present invention is similarly applicable to an image forming apparatus using liquid ink.

The illustrative embodiments each are implemented as a printer including the screws 105 and 106. The present invention is applicable even to an image forming apparatus including any other means for agitating a stored developing liquid, e.g., agitating means that once sucks the liquid 10 from the liquid storing portion 104 with a pump and returns it to the storing portion 104.

The applicator roller 111 serving as a feeding device may be replaced with, e.g., an arrangement in which the liquid 10 sucked from the liquid storing portion 104 is sprayed onto the developing roller ill via a nozzle.

In summary, it will be seen that the present invention achieves various unprecedented advantages, as enumerated below.

(1) There can be obviated short image density, background contamination and short image sharpness ascribable to a developing liquid whose viscosity characteristic is dependent on a shearing force.

(2) The developing liquid to deposit on a liquid carrier contains an image forming substance having a stable content. It is therefore possible to reduce unstable image density ascribable to the deposition of a developing liquid with unstable substance content on the carrier liquid. It is not necessary to use high output motors for driving the liquid carrier and a feeding device. This successfully prevents the cost and weight of an image forming apparatus from increasing.

(3) There can be reduced unstable image density ascribable to the feed of the liquid with unstable substance content to a liquid storing portion. In addition, there can be reduced short image density, background contamination and short image sharpness ascribable to the feed of the liquid with increased viscosity from a liquid container to the liquid storing portion.

(4) The liquid with a substance content lowered to a desired value can deposit on the liquid carrier. This is also successful to achieve the above advantage (1).

(5) As for the liquid in the liquid storing portion and liquid container, it is possible to determine the time when the substance content was uniformed, the time when the viscosity was lowered to a desired value, and the time when the viscosity was lowered to saturation.

(6) There can be obviated unstable image density, short image density, background contamination and short image sharpness ascribable to the difference in spread saturation time and viscosity reduction time between developing liquids. Further, the time for starting driving the liquid carrier and feeding device can be advanced in accordance with the condition of the liquid not agitated. This minimizes the extension of an image forming time ascribable to a preselected agitating time preceding the start of drive of the liquid carrier and feeding device.

(7) The interval between the start of an image forming operation and the start of drive of the liquid carrier is reduced to enhance rapid image formation.

(8) The viscosity of the thin layer can be reduced more than when use is made of a stationary thin layer contact member. This more surely reduces short image density, background contamination and short image sharpness ascribable to the liquid whose viscosity characteristic is dependent on a shearing force. By further reducing the viscosity of the thin layer, it is possible to further reduce the surface tension of the thin layer and therefore the fine undulation of the surface of the thin layer, thereby uniforming the thickness of the thin layer. This is successful to reduce the scatter of image density ascribable to irregularity in the thickness of the thin layer and therefore to stabilize image quality.

(9) A rotary body is rotated at a speed matching with the viscosity of the liquid not subjected to a shearing force, so that wasteful energy consumption is reduced.

(10) There can be obviated the short absolute amount of the liquid to be conveyed to a developing position and therefore short image density ascribable thereto.

(11) The range over which a developing characteristic can be set is broadened. The kinds of developing liquids that can be used are increased. The amount of carrier liquid to deposit on an image carrier is reduced. Therefore, when a toner image is transferred to a paper or similar recording medium pressed against the image carrier, the toner image is free from blur. It is not necessary to use a prewetting liquid that would increase the running cost or to use prewetting liquid applying means that would complicate the construction of the apparatus. Further, when a recycling device is provided for collecting and recycling the liquid left on the image carrier, a device for separating the developing liquid and prewetting liquid is not necessary. This further simplifies the construction of the apparatus.

(12) So long as a specified kind of developing liquid is used, there can be surely obviated short image density and background contamination ascribable to the liquid whose viscosity is depending on a shearing force.

(13) A regulating member and at least part of a shearing force exerting mechanism can be implemented by a single part, reducing the cost and size of the apparatus.

(14) The surface of the image carrier and that of the liquid carrier facing each other move at the same speed in the same direction, so that the distance over which the toner of the thin layer formed on the liquid carrier moves to the image carrier is reduced. This obviates the flow of an image and background contamination when an image pattern is formed, and thereby further enhances image quality.

Various modifications will become possible for those skilled in the art after receiving the teachings of the present disclosure without departing from the scope thereof.

What is claimed is:

1. An image forming apparatus for depositing a thin layer of a developing liquid or an image forming substance contained in said developing liquid on a latent image formed on an image carrier to thereby develop said latent image, comprising a liquid carrier in contact with the image carrier to carry the thin layer of the developing liquid to the image carrier, and a thin layer contact member to contact said thin layer formed on said liquid carrier at a position upstream of a position where said liquid carrier and said image carrier contact each other in a direction in which said liquid carrier is movable, to apply a shearing force to said thin layer, wherein said thin layer contact member comprises a rotary member whose surface is movable, at a position where said rotary member faces said liquid carrier, in a rotation direction opposite to the rotation direction in which said liquid carrier is movable.

2. An apparatus as claimed in claim 1, wherein the developing liquid comprises a carrier liquid and toner, said toner migrating from said liquid carrier toward the latent image formed on the image carrier due to electrophoresis.

3. An apparatus as claimed in claim 2, wherein a surface of the image carrier and a surface of said liquid carrier facing each other move at a same speed in a same direction as each other.

4. A developing device for depositing a developing liquid on a liquid carrier in a form of a thin layer, causing said thin layer to contact an image carrier included in an image forming apparatus, and depositing said thin layer or an image forming substance contained in said thin layer on a latent image formed on said image carrier to thereby develop said latent image, comprising a liquid carrier in contact with the image carrier to carry the thin layer of the developing liquid to the image carrier, and a thin layer contact member to contact said thin layer formed on said liquid carrier at a position upstream of a position where said liquid carrier and said image carrier contact each other in a direction in which said liquid carrier is movable, to apply a shearing force to said thin layer, wherein said thin layer contact member comprises a rotary member whose surface is movable, at a position where said rotary member faces said liquid carrier, in a rotation direction opposite to the rotation direction in which said liquid carrier is movable.

* * * * *